United States Patent [19]

Graham

[11] 4,358,218

[45] Nov. 9, 1982

[54] APPARATUS FOR CONFINING THE EFFLUENT OF AN OFFSHORE UNCONTROLLED WELL

[75] Inventor: William J. Graham, Metairie, La.

[73] Assignee: Texaco Inc., White Plains, N.Y.

[21] Appl. No.: 339,569

[22] Filed: Jan. 15, 1982

Related U.S. Application Data

[63] Continuation of Ser. No. 104,327, Dec. 17, 1979.

[51] Int. Cl.[3] ..... E02B 15/04

[52] U.S. Cl. ..... 405/60; 210/922; 405/52

[58] Field of Search ..... 405/60, 52, 188, 195, 405/209; 210/922, 923

[56] References Cited

U.S. PATENT DOCUMENTS

| | | | |
|---|---|---|---|
| 3,389,559 | 6/1968 | Logan | 405/60 |
| 3,599,434 | 8/1971 | Missud | 405/60 |
| 3,610,194 | 10/1971 | Siegel | 405/60 X |
| 3,653,215 | 4/1972 | Crucet | 405/60 |
| 3,664,136 | 5/1972 | Laval et al. | 405/60 |
| 3,667,605 | 6/1972 | Zielinski | 405/60 X |
| 3,981,154 | 9/1976 | Hix | 405/60 |
| 4,047,390 | 9/1977 | Boyce II | 405/188 |

*Primary Examiner*—Dennis L. Taylor

*Attorney, Agent, or Firm*—Carl G. Ries; Robert A. Kulason; Robert B. Burns

[57] ABSTRACT

A bell-like apparatus adapted to be lowered to the ocean floor and controllably positioned to cover an uncontrolled well. The control means includes a plurality of anchors which are dispersed about the well to guide a series of tensioning cables. The latter are attached to the bell, threaded through the respective anchors, and thereafter led to the surface of the water by an elongated conduit whereby they can be controlled.

5 Claims, 3 Drawing Figures

APPARATUS FOR CONFINING THE EFFLUENT OF AN OFFSHORE UNCONTROLLED WELL

This is a continuation of application Ser. No. 104,327, filed Dec. 17, 1979.

BACKGROUND OF THE INVENTION

In the drilling of or producing of any offshore well there exists the risk that there will be a blowout. A blowout in effect constitutes the presence of an excessive amount of gas pressure which is acting on the fluid reservoir into which the well is communicated. The result is that often the gas pressure on the fluids is so great as to overcome the resisting pressure of the various control valves.

As a matter of general practice, the drilling of any well bore to produce hydrocarbons whether gaseous or liquid, entails the use of certain safety equipment. More particularly, this safety equipment requires the presence of control valves which are firmly attached to the well casing whereby to control the passage of fluid upwardly through the casing.

Often these flow control valves are incorporated into a Christmas tree arrangement such that upward movement of hydrocarbons can be regulated to a desired flow rate. During a drilling operation however, the control valves are supplemented by blowout preventer apparatus. The latter is a form of equipment which operates either automatically or otherwise to control or close off a well bore. This is done so that the well can be closed in even though the drill string or parts of the latter remain in the bore.

In some instances, the well might be uncontrolled due to an unconsolidated substrate that is not particularly firm. Thus, although the well might be capped or otherwise blocked, the hydrocarbons can nonetheless be forced out through fissures formed in the earth by virtue of the great gas pressure. In any event, it is desirable while suitable means is being determined for closing in a well, that the uncontrolled escape of effluents be regulated or at least contained within some confining apparatus.

It is appreciated that the escaping effluent is not merely the upward passage of crude oil or liquids. A major factor of concern is the escape of large quantities of gas which have caused the blowout. In the instance of the latter, as the gas escapes from the earth it will expand into the water, and thereafter the rising bubbles will expand even further.

The result of this rapid passage of large quantities of gas through the water usually causes a severe turbulence in the latter. The surface of the water will not only be bubbling and turmoiled, but the area or corridor between the well bore and the water's surface, will likewise exhibit considerable turbulence.

A problem normally encountered in confining such wells by a bell or other similarly shaped enclosure resides in the inability to position the closure means due to the water turbulence. In effect, the rising gases tend to upset and disrupt any descending body which might otherwise be lowered to the ocean floor for the purpose of covering or enclosing the uncontrolled wellhead.

Toward overcoming this problem, the instant apparatus is addressed to a bell-like member particularly adapted to be drawn to the ocean floor and thereafter positioned in place. This is achieved through the preplacing of a number of anchors about the well. The anchors serve to guide a plurality of pull down cables which in turn are attached to the enclosing bell and which are led to the surface of the water. As a result, the entire operation can be conducted from several barges positioned about, but spaced from the turbulent water area.

Operationally, the confining bell is lowered toward the uncontrolled well, yet is spaced sufficiently distant from the latter as not to be affected by the troubled waters. When the bell reaches the ocean floor it is drawn laterally, by manipulation of the control cables, toward the well such that the bell can be properly positioned with respect to the well.

Thereafter, rising gases, as well as liquid hydrocarbons will be partially confined and directed upward through the bell and into an elongated conduit. From the latter, the fluids can be led to a separation barge or other equipment at the water's surface where the water, oil and gas will be separated.

It is therefore an object of the invention to provide an apparatus of the type contemplated which is particularly adapted to be lowered to the ocean floor to form at least a partial closure over an uncontrolled well.

A further object is to provide an apparatus of the type contemplated which can be controlled entirely from the water's surface thereby avoiding excessive risks to workmen.

Another object is to provide a well control device which is capable of confining rapidly emitted gases and fluids from an uncontrolled offshore well such that the effluent can be collected and separated into discrete components.

DESCRIPTION OF THE DRAWINGS

Referring to FIG. 1, an environmental view of the present apparatus is shown. Here, a well 10 is illustrated as being partially bored into the ocean floor from a surface vessel, and including at least one string of casing 11 which has been lowered into the well.

Figure 1:
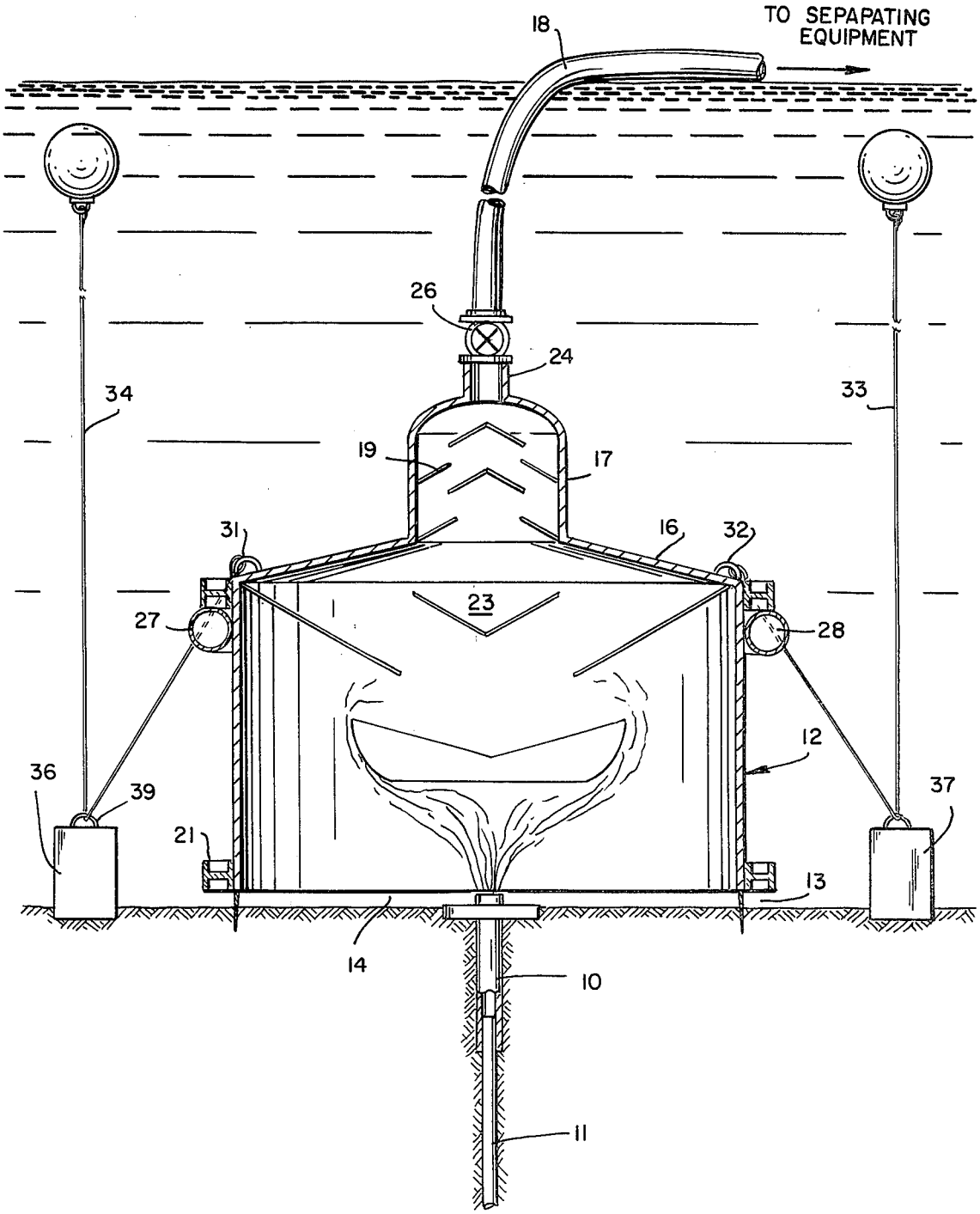
FIG. 1 is an environmental view of the present bell structure shown positioned at the ocean floor.

As previously mentioned, a blowout can occur at any time during the well drilling operation and will only become uncontrollable when the normal blowout prevention equipment has been bypassed, damaged, or otherwise becomes unusable. In the present arrangement, such equipment is not shown at the wellhead since it will be assumed that the equipment has been put out of operation of has otherwise been rendered useless.

In any event, the present apparatus is such that it will not only confine or collect the uncontrolled fluid flow, but can also enclose any such equipment that is positioned on or adjacent to the wellhead.

The provisional or temporary well closure herein contemplated is embodied in a bell-like collector member 12 comprising an elongated, cylindrical side wall, having a lip 13 at one end which defines an open inlet 14. The other end of the bell is provided with a closure wall 16 into which is incorporated constricting means 17 for directing the rising fluids into a conduit 18, such as a hose, flexible pipe or other means. In either instance conduit 18 is preferably prepositioned on the bell in a manner to facilitate the latter being lowered to the ocean floor.

The bell-like collector is preferably formed of steel, being sufficiently wide about peripheral lip 13 or the mouth, to cover the area through which the fluids are escaping from well 10 or other apertures about the well.

The upper wall of bell-like collector 12 is provided in one embodiment as noted, with a constricted portion which defines an afterchamber 20, in which a plurality of baffles 19 are dispersed. The latter has the purpose of stabilizing the upward flow of the fluids into the escape conduit 18 which extends to the ocean surface and thence to separating equipment.

As previously mentioned, the apparatus when it is being drawn into place, will be subject to a considerable degree of turbulence due primarily to the gas bubbles which rise from well 10. While bell 12 must be sufficiently structurally rigid to resist a certain amount of abuse, it does not necessarily have to be overly heavy to resist the pressure of the rising gas bubbles.

Preferably, bell 12 is formed of a framework of structural members which define a cylindrical, or a square enclosure. The basic structural members 21 and 22 are thereafter provided with a steel jacket of sufficient thickness to be readily riveted or welded into place.

As noted above, the upper end of the bell 12 is provided with an afterchamber 20 formed similarly of steel plate, which chamber opens up directly into the main chamber 23 of bell 12. Said afterchamber 20 is in turn provided with an outlet 24 through which the gases and liquid rise during their passage to the water's surface.

Outlet 24 can be provided with flow control valving 26 or other means for regulating the volume of the fluids as they rise. It should be appreciated, however, in that well 10 is relatively uncontrolled, the use of such members to restrict the flow may be entirely ineffectual or even undesirable.

Lower lip 13 of bell 12 can be provided with a tip or edge which is capable of being forced into the surface of the ocean floor. However, bell 12 can be positioned in a manner to be suspended above well 10 while maintaining its primary function of collecting upwardly passing fluids.

It should be appreciated, however, that because of the turbulence of the water and the expanding gas bubbles such suspended positioning might be tenuous. This results since the bell 12 would be in constant motion due primarily to the excessive pressures generated by expanding gases, and to the excessive upward velocity of said gases.

The buoyancy of bell 12 is provided through entrapped air and through one or more buoyancy tanks 27 and 28 which are disposed about the upper end of the bell and separated into discrete compartments. These tanks are communicated with control means at the surface including pumps, compressors and the like.

Bell 12 is provided with a plurality of cable receiving terminals 31 and 32 disposed about the upper edge thereof. Said cable fastening means can be in the form of eye bolts or the like which depend outwardly from the surface of the bell and are adapted to receive the eye splice of control cables 33, 34 and 41. Alternatively the cable connection can be in the form of a pulley or the like through which the cable is threaded as it is brought upwardly from lip 13 to the top or upper rim of the bell.

The respective anchors 36, 37 and 38 which serve to fixedly position the cable guide means, can be of any of a number of types. However, to best serve the function it is found that such anchors are preferably heavy enough, or of the dead weight type, to resist the upward force of the gas acting against the confining bell. In one embodiment, the positioning anchor 36 as shown, is formed primarily of a concrete body. the top end of which is provided with a cable guide 40. The latter can be in the form of an eye, a pulley or other appropriate means depending on the use to which the cable guide will be subjected as herein to be shown.

Figure 2:
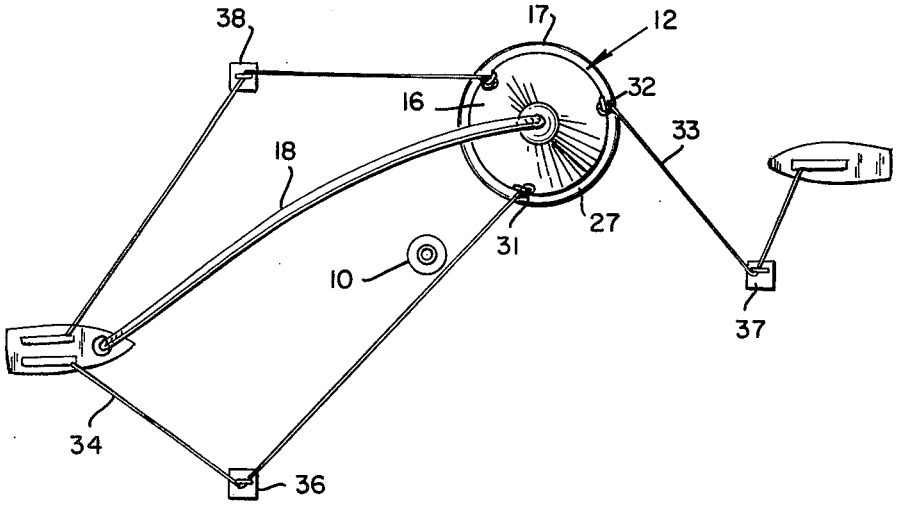
FIG. 2 is an enlarged view of the bell structure.
Figure 3:
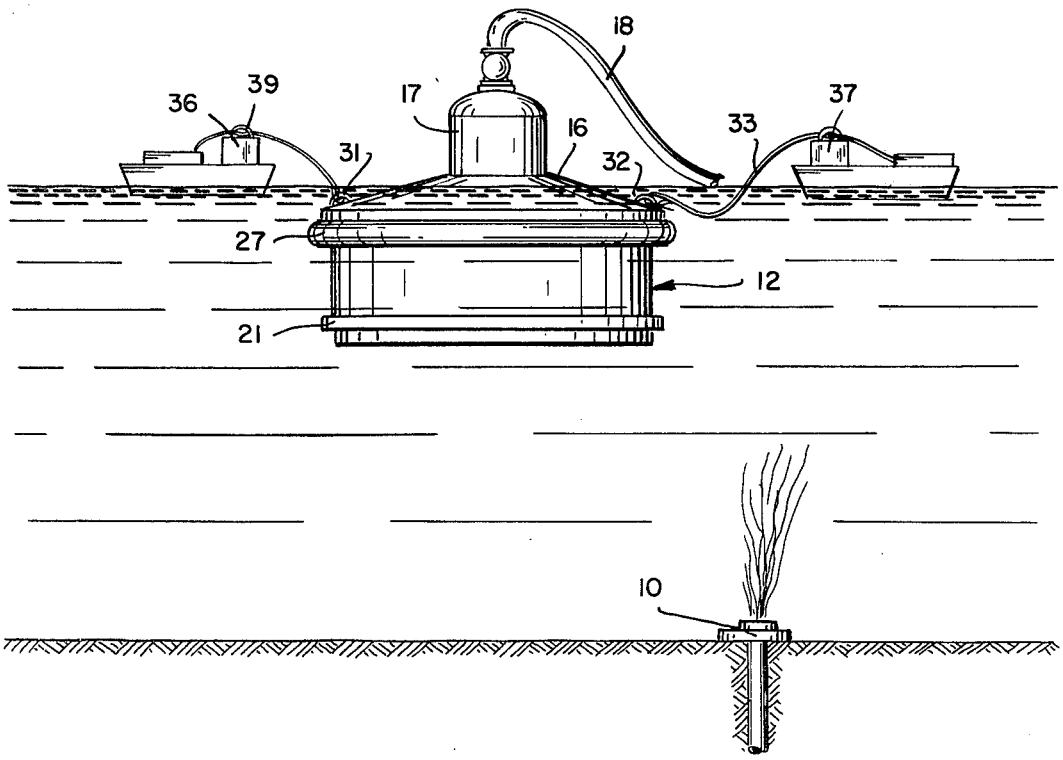
FIG. 3 is similar to FIG. 2.

As shown in FIG. 2, preferably the anchors number at least three. Said anchors 36, 37 and 38, are positioned about the well 10 preferably to be substantially equispaced from the latter and circularly arranged. They thereby in essence define a triangle of forces which cooperate to laterally position the bell 12 during its downward passage through the water.

Bell 12, as noted, is provided with at least three control cables, 33, 34 and 41, each of which is fixed to the bell. The cable is then guided through the anchor cable guide 40, and then passes to the surface of the water. At the latter, the respective cables can be wound onto a winch or other take-up means capable of applying tension, or adjusting the tension on the various cables.

In this respect, the cables can terminate at a single vessel or be directed to separate vessels spaced about the well.

Operationally, when it is required to close off or confine the flow of escaping fluids from an uncontrolled well 10, the bell 12 is brought into the waters adjacent to the well itself. Initially, the various pull down anchors 36, 37 and 38, are located. This is done either by lowering the anchors directly downward from a barge at the surface or by guiding the anchors down through the use of a plurality of barges and work boats. The latter can guidably position the anchor during its descent and placement to assume the desired location with respect to well 10.

The accurate positioning of the respective anchors is not considered to be problematical since present technology permits the use of underwater cameras, television equipment and other devices. The latter are capable of accurately monitoring and determining the location of any apparatus being lowered and placed at the ocean floor. The anchors can alternatively be guided into place by submarines or other underwater vessels and apparatus which serve to move the suspended anchor about prior to its being set onto the ocean floor.

When the three or more anchors are in place, the respective control cables 33, 34 and 41 can be threaded through the cable guide means at the anchor. Alternatively, and more preferably, the cable can be prepositioned or threaded into cable guide 48 prior to the anchor being located so long as care is maintained that the cables do not interfere with the anchor lowering operation.

When the three or more anchors are firmly placed, the remote end of the control cable, 33 for example, is fastened to appropriate reel-in apparatus as herein noted. Thereafter, bell 12, supplemented by its own buoyancy, is lowered into the water and permitted to controllably descend to the ocean floor. As the bell approaches the bottom, the tension on the three control cables is varied to bring the bell into alignment with the well.

To facilitate the operation, the bell itself can be provided with television or sonar equipment whereby guiding of the unit can be readily accomplished. If need be, the bell can be lowered from one side of the well to avoid water turbulence. Thereafter, by varying tension on the respective cables, the bell is drawn laterally to its working position over wellhead 10. When properly aligned, by applying tension to the various hold down cables the bell is brought into relatively close proximity to the ocean floor. It will then be in a position to receive the upwardly passing hydrocarbons into the mouth of the bell.

When located, bell 12 is preferably fastened in place. This is achieved most readily at the respective anchors where the cables can be drawn tight so that the bell is no longer influenced by movement of the water. In such a position, the bell can now function to confine the upwardly moving hydrocarbon fluid and guide the latter to the water's surface by way of conduit 18.

The gas and liquids are then received in appropriate separating tanks. Here the liquid can be further separated such that oil and the water are carried away in distinct flows while the gas is confined and directed to a suitable storage means.

Other modifications and variations of the invention as hereinbefore set forth can be made without departing from the spirit and scope thereof, and therefore, only such limitations should be imposed as are indicated in the appended claims.

I claim:

1. Apparatus for confining an uncontrolled fluid stream which is issuing from an aperture or well in the floor of a body of water, said well being communicated with a reservoir of pressurized fluid within the substrate of said floor, which apparatus includes;

a plurality of anchors disposed at said ocean floor, being spaced outwardly from the head of said well and having cable guide means thereon, a bell structure comprising an elongated side walled member having a lip at one end which defines a lower opening, a wall disposed at the bell other end forming a substantial closure across said other end, and a buoyancy ring disposed circumferentially about said side walled member and adjacent to said wall at the bell other end, a discharge port in said bell structure having means thereon for engaging an elongated conduit extending to the water's surface, a plurality of elongated tensioning cables, each thereof having one end connected to said bell at said wall and at circumferentially spaced intervals, and said tensioning cables each being slidably received in a cable guide means at one of said anchors, the cable remote end being engaged with take-up means at the water's surface which is operable to adjust the cable tension, whereby positioning of said bell with respect to the well in said floor, can be adjusted to align the bell over the well, thereby to receive and direct the fluid stream issuing therefrom into said elongated conduit.

2. In the apparatus as defined in claim 1, including; an elongated conduit means communicated with said discharge port and extending to the water's surface.

3. In the apparatus as defined in claim 1, wherein said plurality of anchors includes; at least three anchor members disposed circumferentially of said well.

4. In the apparatus as defined in claim 1, wherein said elongated conduit is positioned to avoid fluid flow therethrough prior to said bell apparatus being positioned in place above said well.

5. In the apparatus as defined in claim 1, wherein the respective elongated cables are connected to the bell upper end and guided through cable guide means at the bell lip.

* * * * *